United States Patent [19]

Uban et al.

[11] 4,070,277

[45] Jan. 24, 1978

[54] APPARATUS FOR SEPARATING SOLIDS FROM LIQUIDS

[75] Inventors: Stephen Allen Uban, Lenexa; Donald George Mason, Overland Park, both of Kans.

[73] Assignee: Ecodyne Corporation, Lincolnshire, Ill.

[21] Appl. No.: 770,473

[22] Filed: Feb. 22, 1977

[51] Int. Cl.[2] ..... B03D 1/14

[52] U.S. Cl. ..... 209/168; 210/525; 210/528

[58] Field of Search ..... 210/519, 520, 523, 525, 210/528, 221 P, 44; 209/168, 170

[56] References Cited

U.S. PATENT DOCUMENTS

| | | | |
|---|---|---|---|
| 1,102,463 | 7/1914 | Wyckoff | 210/519 |
| 2,297,586 | 9/1942 | Steffensen | 209/170 |
| 2,876,863 | 3/1959 | Kivari | 210/44 X |
| 3,179,252 | 4/1965 | Vrablik | 210/44 X |
| 3,246,763 | 4/1966 | Baum | 210/221 P |
| 3,485,365 | 12/1969 | Keller | 210/519 X |
| 3,542,675 | 11/1970 | Mail et al. | 210/221 P X |
| 3,642,617 | 2/1972 | Brink et al. | 210/44 |
| 3,647,069 | 3/1972 | Bailey | 210/44 |

*Primary Examiner*—William A. Cuchlinski, Jr.
*Attorney, Agent, or Firm*—Joel E. Siegel; Charles M. Kaplan

[57] ABSTRACT

Apparatus that removes solids from a liquid by flotation and by sedimentation has a uniform surface distribution of small bubbles for making solids float. Large bubbles which would cause turbulence and uneven bubble flow are confined and eliminated.

10 Claims, 4 Drawing Figures

APPARATUS FOR SEPARATING SOLIDS FROM LIQUIDS

BACKGROUND OF THE INVENTION

In dissolved air flotation clarifiers, compressed air is dissolved in a relatively solids free pressurized liquid such as previously clarified process effluent. This air charged liquid stream (called pressurized flow) is passed through a pressure reduction valve which produces a large quantity of bubbles in the liquid. The bubbles will attach to the solid particles in waste being clarified and cause such particles to float to the surface for removal. The efficiency and effluent quality of such clarifiers is dependent on control of the size and distribution of the bubbles. The performance of prior art dissolved air flotation clarifiers has been adversely affected by the presence of uncontrollable large bubbles. Such large bubbles rise very rapidly causing pockets of uncontrolled turbulence. Also, prior art clarifiers have not achieved a satisfactory degree of small bubble distribution over the entire surface of the liquid.

SUMMARY OF THE INVENTION

Accordingly, it is an object of this invention to provide an improved dissolved air flotation clarifier.

Another object is to provide such a clarifier having a relatively uniform distribution of small bubbles.

Another object is to provide a flotation clarifier in which the deleterious effects of bubbles of uncontrolled large size are reduced or eliminated.

Another object is to provide apparatus that effectively removes solids from liquids by both flotation and sedimentation.

Another object is to provide liquid clarification apparatus that is relatively economical, durable, and easy to adjust and maintain.

Another object is to provide a dissolved air flotation clarifier with a feedwell that receives the incoming pressurized flow and holds the solids and bubbles therewithin for a predetermined minimum time period sufficient to cause most of the solids to become attached to small bubbles before leaving the feedwell.

Another object is to improve apparatus for separating solids from liquids so as to eliminate defects found in prior art systems.

Other objects and advantages of the invention will be found in the specification and claims, and the scope of the invention will be set forth in the claims.

Briefly stated, according to one aspect of the invention, the pressurized flow of a dissolved air flotation clarifier is fed into a partially perforated enclosure. Small bubbles in the enclosure attach to the suspended solids and then pass through the perforations into the clarifier where they rise to the surface of the liquid, but large bubbles are trapped within the enclosure and vented directly to the atmosphere.

DESCRIPTION OF THE INVENTION

Figures 1, 3:
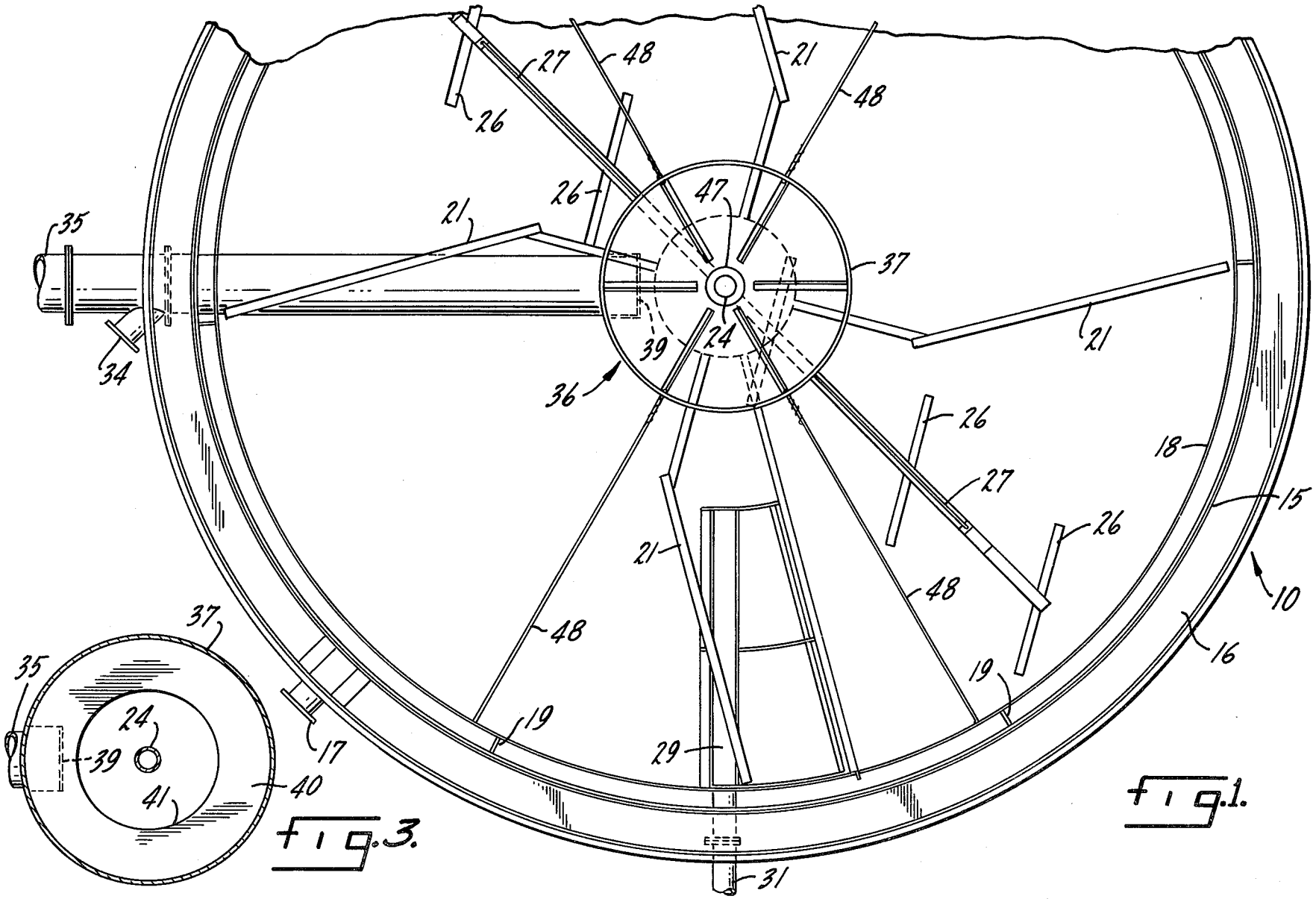
FIG. 1 is a partially broken-away top plan view of apparatus in accord with this invention.
FIG. 3 is a plan view taken along the line 3—3 in FIG. 2.
Figures 2, 4:
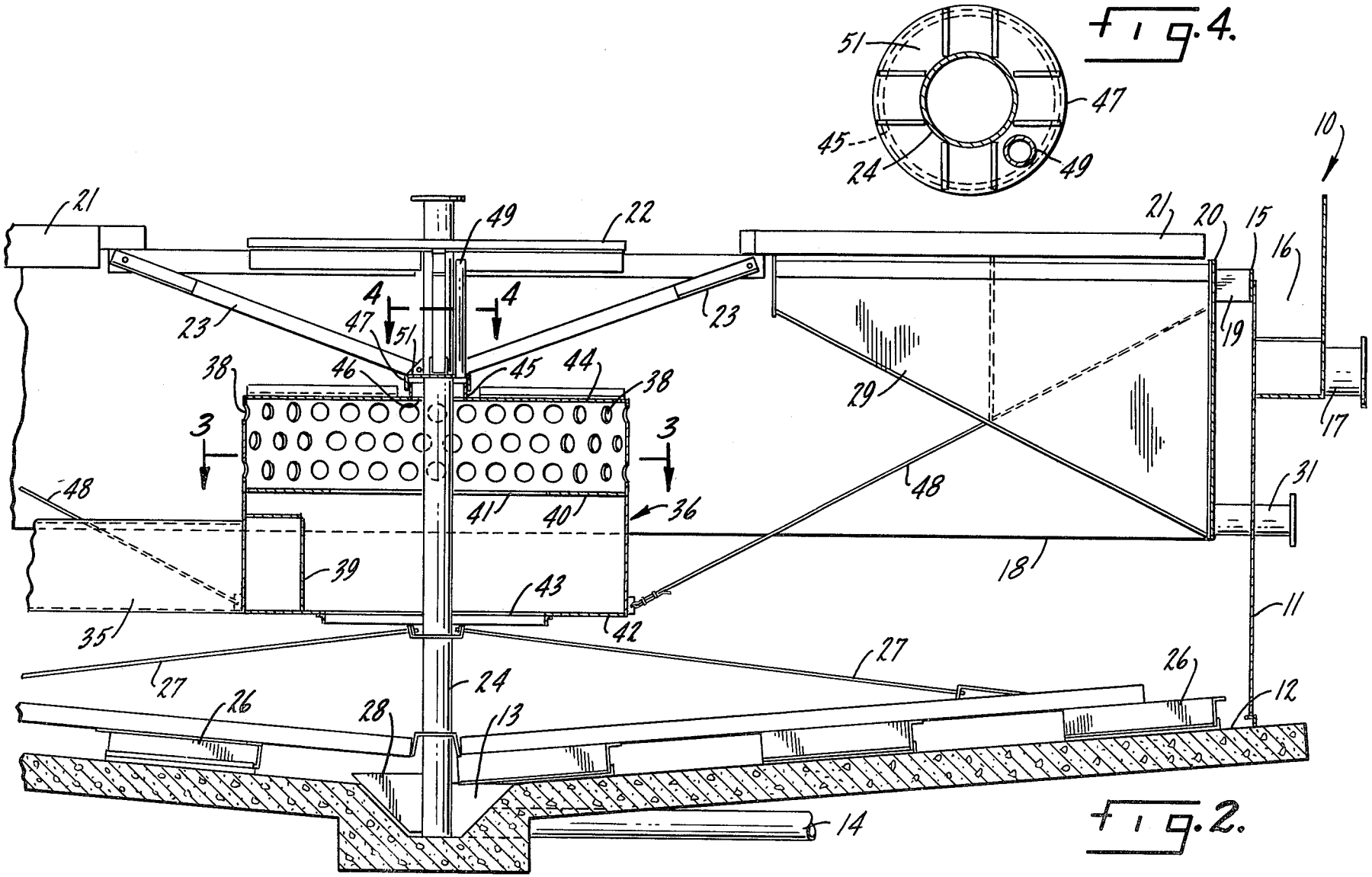
FIG. 2 is a partially broken-away side elevation of the apparatus shown in FIG. 1.
FIG. 4 is a plan view taken along the line 4—4 in FIG. 2.

The drawing shows a dissolved air flotation clarifier 10 for separating the solids from the liquid component of sewage or industrial waste by both sedimention and flotation. A cylindrical vessel 11 has a conical bottom 12 which slopes to a center depression 13. A first solids outlet conduit 14 communicates with depression 13 for removal of settled solids. An overflow weir defined by the upper edge 15 of vessel 11 controls the level of liquid in vessel 11, and collection trough 16 conveys clarified liquid to a liquid outlet conduit 17. A cylindrical scum baffle 18 is supported radially inwardly of vessel 11 by brackets 19. The upper edge 20 of baffle 18 extends above the surface of the liquid and thereby confines floatable solids within baffle 18. A plurality of radially extending rotatable paddles 21 are schematically depicted in the drawing. Paddles 21 are attached to circular disc 22 and supported by struts 23. Disc 22 is attached to and rotates with a center torque shaft or tube 24. A plurality of bottom scraping rakes 26 are attached to torque tube 24 and supported by cables 27. Conventional motor means (not shown) slowly rotates torque tube 24 and this causes rakes 26 to scrape settled solids down bottom 12 to depression 13 where plows 28 attached to tube 24 further thicken the settled solids prior to removal in conventional manner through conduit 14. Rotation of paddles 21 forces floating solids adjacent the surface of the liquid into trough 29 from which they are removed through a second solids outlet conduit 31. Paddles 21 and trough 29 may be constructed and operated as disclosed in U.S. Pat. No. 3,919,090, which is assigned to the same assignee as this invention.

Floatable solids are carried toward the upper surface of the liquid in vessel 11 by bubbles formed by a gas-liquid mixture that enters through pipe 34 and is mixed with incoming solids and liquids in inlet conduit 35. For example, pressurized flow consisting of water saturated with air compressed by conventional means to a pressure of about 40 p.s.i. will produce countless bubbles having diameters of from about 25–50 microns, when passed through a pressure reduction valve and released to atmospheric pressure in conduit 35.

The small bubbles will be confined and mixed with floatable solids for a sufficient length of time to assure adequate contact and then will be uniformly dispersed when the mixture in conduit 35 is fed into a stationary center feedwell enclosure 36 in accordance with this invention. Sidewall 37 of enclosure 36 has the shape of a right circular cylinder with tube 24 at its longitudinal centroidal axis. A plurality of perforations 38 are uniformly spaced around the upper half only of sidewall 37 below the upper surface thereof. A vertical baffle 39 disperses incoming solids, liquid and gas bubbles around the inside of enclosure 36 below a horizontal baffle 40 having a center opening 41. Relatively heavy solids are trapped in the lower chamber of enclosure 36 by baffle 40, while hole 41 permits rise of bubbles and fine solids into the perforated upper chamber. A bottom closure member in the form of a flat plate 42 perpendicular to the axis of enclosure 36 permits settling of the large solids through a circular opening 43 at its center. A plate 44, which may be flat or may be an inverted cone, spans the top of enclosure 36 so as to define a top closure member. An upstanding annular rim 45 on plate 44 defines a circular hole 46 in the center of plate 44. Hole 46 is closed by an inverted cup-shaped seal 47, which is secured to the outside of and rotates with torque tube 24. Seal 47 telescopes over rim 45 and has a sliding fit therewith. The bottom of enclosure 36 is held in place by cables 48 attached to baffle 18. The top of enclosure 36 is vented to the atmosphere through a pipe 49 having its lower end communicating with the inside of enclosure 36 through the horizontal surface 51 of seal 47 and its upper end extending above the surface of the liquid. Pipe 49 rotates with seal 47 thereby passing the pipe entrance opening over a constantly changing area of hole 46.

The bubbles in enclosure 36 can enter vessel 11 essentially only by passing through the perforations 38 in its upper half. The size of perforations 38, the diameter and height of wall 37 and the vertical location of enclosure 36 can be predetermined in relation to the volume of pressurized flow and raw waste leaving conduit 35 so as to produce a relatively uniform distribution of fine bubbles throughout the liquid within baffle 18. It is necessary that the volume of enclosure 36 be sufficient to result in a minimum of 45 to 60 seconds of detention time for solids and bubbles therewithin. This will ensure that the turbulent flow in enclosure 36 will cause essentially all of the floatable solids to contact and adhere to small bubbles. The escaping bubbles will quickly carry to the surface for removal of the small solid particles that would be slow to settle to bottom 12. An excess of small bubbles should be produced so that solid particles which break up after leaving enclosure 36 are caught by the excess bubbles and carried to the surface. Inevitably, some large bubbles form in enclosure 36. These large bubbles rise immediately to the top of enclosure 36 where they migrate into hole 46 and out to the atmosphere through pipe 49. Rotation of pipe 49 around hole 46 prevents isolation of pockets of gas therewithin.

In an embodiment of the invention used to clarify refinery waste, 450 gallons per min. of pressurized flow at 40 p.s.i. passed through a presure reduction valve and then was mixed with 900 gallons per min. of oily waste and fed into an enclosure 36 having an 84 inch diameter and a height of 48 inches. Horizontal baffle 40 was located 12 inches above the bottom edge of scum baffle 18. Three rows of 4 inch diameter circular perforations were spaced at 6/16 and 9/16 inch intervals around its sidewall 37, the centers of the uppermost row being 3 inches from the top of sidewall 37 and the centers of the remaining two rows of perforations being spaced respectively 6 and ½ inches lower. Baffle 40 was spaced twenty-one inches below the top of sidewall 37. Openings 41 and 43 both had a diameter of 36 inches, hole 46 had a 12 inch diameter, and vent pipe 49 had a 2 inch diameter and made a maximum of 10 revolutions per hour. Baffle 18 had a diameter of 28 feet, and vessel 11 had a diameter of 30 feet and a volume of 6000 cu. ft. After startup and adjustment, visual observation of the operation of this clarifier revealed an essentially uniform distribution of fine bubbles over the entire surface of the liquid within baffle 18. No large bubbles or areas of turbulence were observed. The bubbles released in vessel 11 were in the size range of about 25 to 50 microns.

It has thus been shown that by the practice of this invention the uncontrollable turbulence and disruptions caused by large bubbles are eliminated. The structure of enclosure 36 causes such large bubbles to be isolated and then vented directly to the atmosphere. This results in an essentially uniform distribution of very fine bubbles over the entire surface of the liquid within baffle 18 and produces better liquid clarification. Also, the structure and volume of enclosure 36 are related to the volume of waste and pressurized flow so as to produce a controlled turbulence of sufficient duration to ensure adherence of the floatable solids to bubbles before they escape from the enclosure.

While the present invention has been described with reference to a particular embodiment, it is not intended to illustrate or describe herein all of the equivalent forms or ramifications thereof. Also, the words used are words of description rather than limitation, and various changes may be made without departing from the spirit or scope of the invention disclosed herein. It is intended that the appended claims cover all such changes as fall within the true spirit and scope of the invention.

What is claimed is:

1. Apparatus for separating solids from liquids comprising a vessel having a clarified liquid outlet conduit, means at its bottom for collecting settled solids for disposal through a first solids outlet conduit, means for collecting floatable solids and for passing such floatable solids through a second solids outlet conduit, and means for raising such floatable solids towards the surface of said liquid comprising an enclosure submerged below the surface of said liquid having a perforated wall, inlet means for feeding a mixture of solids, liquid and gas bubbles in the size range of 25 – 50 microns into the interior of said enclosure, means for preventing escape of gas bubbles into said vessel except through the perforations in said wall comprising a top closure spanning said enclosure and a pipe passing through said top closure and extending above the surface of said liquid so as to vent the interior of said enclosure to the atmosphere, the relative volume of said enclosure and the sizing and location of said perforations causing a relatively uniform distribution of said gas bubbles throughout said vessel for raising said flotable solids, and a bottom closure member for said enclosure having a central opening therethrough permitting solids in said enclosure to escape to the bottom of said vessel.

2. Apparatus for separating solids from liquids comprising a circular vessel having a clarified liquid outlet conduit at its periphery, a depression at the center of the bottom of said vessel for collecting settled solids for disposal through a first solids outlet conduit, a circular scum baffle located radially inwardly of said periphery and having an upper edge extending above the surface of the liquid in said vessel, means for collecting floatable solids and for passing such floatable solids through a second solids outlet conduit, and means for raising such floatable solids toward the surface of said liquid comprising a circular enclosure at the center of said vessel submerged below the surface of said liquid having a perforated generally vertical side wall, an inlet conduit for feeding a mixture of solids, liquid, and gas bubbles into the interior of said enclosure for turbulent mixing of bubbles and floatable solids, means for preventing escape of gas bubbles into said vessel except through the perforations in said side wall comprising a top closure spanning said circular enclosure and a pipe passing through said top closure and extending above the surface of said liquid so as to vent the interior of said circular enclosure to the atmosphere, and the sizing and location of said perforations causing a relatively uniform distribution of small gas bubbles throughout said vessel for raising said floatable solids, and a bottom closure member for said circular enclosure having a central opening therethrough permitting solids in said circular enclosure to escape to the bottom of said vessel.

3. The invention defined in claim 2 wherein said circular enclosure is a right circular cylinder, said top and bottom closures are each flat plates lying in planes that are perpendicular to the longitudinal centroidal axis of such cylinder.

4. The invention defined in claim 2 wherein the perforations in said vertical side wall are located only in its upper half.

5. The invention defined in claim 2 further comprising a rotatable bottom rake for scraping settled solids into said depression, a rotatable paddle at the surface of said liquid for skimming floating solids enclosed within said scum baffle to said means for collecting floatable solids, and a shaft for rotating both said rake and said paddle passing through the center of said circular enclosure.

6. The invention defined in claim 2, further comprising a baffle spanning the interior of said enclosure above said inlet conduit, there being a relatively large opening through the center of said baffle.

7. The invention defined in claim 2, further comprising the volume of said enclosure being sufficient to detain solids and bubbles therewithin for about 45 – 60 seconds.

8. Apparatus for separating solids from liquids comprising a circular vessel having a clarified liquid outlet conduit at its periphery, a depression at the center of the bottom of said vessel for collecting settled solids for disposal through a first solids outlet conduit, a circular scum baffle located radially inwardly of said periphery and having an upper edge extending above the surface of the liquid in said vessel, means for collecting floatable solids and for passing such floatable solids through a second solids outlet conduit, and means for raising such floatable solids toward the surface of said liquid comprising a circular enclosure at the center of said vessel submerged below the surface of said liquid having a perforated generally vertical side wall, an inlet conduit for feeding a mixture of solids, liquid, and gas bubbles into the interior of said enclosure for turbulent mixing of bubbles and floatable solids, means for preventing escape of gas bubbles into said vessel except through the perforations in said side wall comprising a top closure spanning said circular enclosure and a pipe passing through said top closure and extending above the surface of said liquid so as to vent the interior of said circular enclosure to the atmosphere, the sizing and location of said perforations causing a relatively uniform distribution of small gas bubbles throughout said vessel for raising said floatable solids, and said top closure comprising an upstanding rim defining a hole through said top closure, an inverted cup-shaped seal telescoping over said rim so as to close said hole, and said pipe passing through said inverted cup-shaped seal.

9. Apparatus for separating solids from liquids comprising a circular sedimentation vessel having a peripheral weir over which clarified liquid flows to a liquid outlet conduit, a depression at the center of the bottom of said vessel for collecting settled solids for disposal through a first solids outlet conduit, a circular scum baffle located radially inwardly of said weir and having an upper edge extending above the surface of the liquid in said vessel, means for collecting floatable solids and for passing such floatable solids through a second solids outlet conduit, a right circular cylindrical enclosure at the center of said vessel submerged below the surface of said liquid, a horizontal baffle with a large hole in its center dividing said enclosure into upper and lower chambers, said enclosure having a generally vertical side wall with spaced perforations in only its upper half, an inlet conduit for feeding a mixture of solids, liquid, and air bubbles into said lower chamber, means spanning and sealing said enclosure at its top and a pipe passing through said sealing means and extending above the surface of said liquid so as to vent the interior of said upper chamber to the atmosphere for preventing escape of air bubbles except through the perforations in said side wall, a bottom closure member of said enclosure having a central opening therethrough permitting solids in said enclosure to escape to the bottom of said vessel, the volume of said enclosure being sufficient to detain floatable solids and air bubbles therewithin for about 45 – 60 seconds, a rotatable bottom rake for scraping settled solids into said depression, a rotatable paddle at the surface of said liquid for skimming floating solids enclosed within said scum baffle to said means for collecting floatable solids, a rotatable shaft for rotating both said rake and said paddle passing through the center of said sealing means, said vent pipe also rotating with said shaft.

10. Apparatus for separating solids from liquids comprising a sedimentation vessel having a weir over which clarified liquid flows to a liquid outlet conduit, a depression in the bottom of said vessel for collecting settled solids for disposal through a first solids outlet conduit, means for collecting floatable solids and for passing such floatable solids through a second solids outlet conduit, means for raising such floatable solids toward the surface of said liquid comprising an enclosure submerged below the surface of said liquid having a generally vertical side wall with spaced perforations only in its upper half, an inlet conduit for feeding a mixture of solids, liquid, and air bubbles in the size range of 25–50 microns into the interior of said enclosure, means spanning and sealing said enclosure and a pipe passing through said sealing means and extending above the surface of said liquid so as to vent the interior of said enclosure to the atmosphere for preventing escape of air bubbles except through the perforations in said side wall, a bottom closure member of said encloure having a central opening therethrough permitting solids in said enclosure to escape to the bottom of said vessel, the volume of said enclosure being sufficient to detain floatable solids and air bubbles therewithin for about 45 – 60 seconds, a rotatable bottom rake for scraping settled solids into said depression, a rotatable shaft for rotating said rake passing through said sealing means, said vent pipe also rotating with said shaft, and the sizing and location of said perforations causing a relatively uniform distribution of said air bubbles throughout said vessel for raising said floatable solids.

* * * * *